US008833012B2

(12) United States Patent
Memari et al.

(10) Patent No.: US 8,833,012 B2
(45) Date of Patent: Sep. 16, 2014

(54) TRANSPARENT SUSTAINABLE WALL SYSTEM

(75) Inventors: Ali M. Memari, State College, PA (US); Joseph A. Standley, Danvers, MA (US)

(73) Assignee: The Penn State Research Foundation, University Park, PA (US)

( * ) Notice: Subject to any disclaimer, the term of this patent is extended or adjusted under 35 U.S.C. 154(b) by 769 days.

(21) Appl. No.: 12/424,111

(22) Filed: Apr. 15, 2009

(65) Prior Publication Data

US 2009/0255194 A1 Oct. 15, 2009

Related U.S. Application Data

(60) Provisional application No. 61/045,107, filed on Apr. 15, 2008.

(51) Int. Cl.

| | |
|---|---|
| ***E06B 3/58*** | (2006.01) |
| ***E06B 3/964*** | (2006.01) |
| ***E06B 1/52*** | (2006.01) |
| ***E06B 1/36*** | (2006.01) |

(52) U.S. Cl.

CPC ..... *E06B 1/36* (2013.01); *E06B 3/9642* (2013.01); *E06B 1/524* (2013.01)

USPC ..... 52/204.591; 52/173.3

(58) Field of Classification Search

CPC ..... E06B 1/366; E06B 1/524; E06B 3/9642

USPC ..... 52/173.3, 204.1, 204.59, 204.591, 235, 52/272

See application file for complete search history.

(56) References Cited

U.S. PATENT DOCUMENTS

| | | | | |
|---|---|---|---|---|
| 4,073,097 | A | | 2/1978 | Jentoft et al. |
| 4,671,027 | A | | 6/1987 | Esposito |
| 4,707,959 | A | * | 11/1987 | Stoakes ..... 52/235 |
| 5,036,637 | A | | 8/1991 | Biebuyck |
| 5,042,923 | A | * | 8/1991 | Wolf et al. ..... 359/275 |
| 5,110,637 | A | * | 5/1992 | Ando et al. ..... 428/34 |
| 5,307,597 | A | * | 5/1994 | Tanikawa et al. ..... 52/97 |
| 5,363,615 | A | | 11/1994 | Christopher et al. |
| 6,093,884 | A | * | 7/2000 | Toyomura et al. ..... 136/244 |
| 6,105,317 | A | * | 8/2000 | Tomiuchi et al. ..... 52/173.3 |
| 6,427,398 | B1 | * | 8/2002 | Levine et al. ..... 52/204.56 |
| 6,442,907 | B1 | * | 9/2002 | Doyon et al. ..... 52/235 |
| 6,523,311 | B2 | * | 2/2003 | Edger ..... 52/204.593 |
| 6,745,527 | B1 | * | 6/2004 | Sherman et al. ..... 52/235 |
| 6,748,709 | B1 | * | 6/2004 | Sherman et al. ..... 52/235 |
| 7,584,579 | B1 | * | 9/2009 | Everitt ..... 52/202 |
| 7,592,537 | B1 | * | 9/2009 | West ..... 136/251 |
| 7,676,999 | B2 | * | 3/2010 | Arias ..... 52/235 |

(Continued)

FOREIGN PATENT DOCUMENTS

JP 1061081 U 3/1998

OTHER PUBLICATIONS

Search Report for co-pending PCT/US2009/040636 listing relevant art cited by the International Searching Authority.

*Primary Examiner* — William Gilbert
*Assistant Examiner* — Alp Akbasli
(74) *Attorney, Agent, or Firm* — McKee, Voorhees & Sease

(57) ABSTRACT

A sustainable energy saving wall utilizing recyclable materials is disclosed for use in construction where the wall provides natural light to the interior of the structure while also providing support without the need for further load bearing structure.

29 Claims, 15 Drawing Sheets

(56) References Cited

U.S. PATENT DOCUMENTS

| | | | | |
|---|---|---|---|---|
| 7,803,466 | B2 * | 9/2010 | Dorsy | 428/596 |
| 7,805,898 | B1 * | 10/2010 | Everitt | 52/202 |
| 7,818,934 | B2 * | 10/2010 | Hall et al. | 52/302.6 |
| 7,827,745 | B2 * | 11/2010 | Franceschet | 52/235 |
| 7,841,138 | B1 * | 11/2010 | Frey | 52/204.5 |
| 7,956,280 | B2 * | 6/2011 | Kobayashi | 136/251 |
| 2003/0226320 | A1 * | 12/2003 | Engebretson | 52/204.5 |
| 2003/0226321 | A1 * | 12/2003 | Engebretson | 52/204.54 |
| 2004/0226232 | A1 * | 11/2004 | Engebretson | 52/204.1 |
| 2005/0050815 | A1 * | 3/2005 | Engebretson | 52/204.52 |
| 2006/0000161 | A1 * | 1/2006 | Darmer et al. | 52/200 |
| 2006/0144013 | A1 * | 7/2006 | Rouanet et al. | 52/782.1 |
| 2007/0079861 | A1 * | 4/2007 | Morali | 136/244 |
| 2008/0302407 | A1 * | 12/2008 | Kobayashi | 136/251 |
| 2009/0277093 | A1 * | 11/2009 | Over | 49/400 |
| 2010/0218455 | A1 * | 9/2010 | Tufts et al. | 52/745.16 |

* cited by examiner

TRANSPARENT SUSTAINABLE WALL SYSTEM

RELATED APPLICATIONS

This application claims priority under 35 U.S.C. §119 to U.S. Patent Application No. 61/045,107 filed Apr. 15, 2008, which application is hereby incorporated by reference in its entirety.

FIELD OF THE INVENTION

The present invention relates to a structural component for residential construction. More particularly, the present invention relates to an energy saving wall system for building a residential structure.

BACKGROUND

The current trend in the building industry encourages owners and design professionals to develop sustainable designs. The market has consequently created a need for building materials and systems compatible with the definition of "green" or sustainable construction. Green materials are considered having attributes such as recyclable, renewable, low-embodied energy, locally available, and high thermal mass. Buildings designed using materials with such "virtues" can result in gaining points in LEED rating system. As a result, building material manufacturers have in general been drawn into a new competition to claim some of this new market share.

Another factor that adds significance to the general trend for sustainable design is energy conservation through the building envelope. Of the total U.S. annual energy consumption, approximately 20% is used on cooling, heating, and lighting buildings. A considerable amount of this energy is lost through the building envelope. For this reason, the thermal mass property has been identified as one factor that can significantly influence energy conservation in buildings. A wall with high thermal mass can store large amounts of radiated solar energy during the day and slowly release it to the interior during the night. This process can regulate the indoor temperature fluctuations by delaying and slowing down the heat flow through the wall, thus reducing the need for heating and cooling loads. Construction materials such as masonry and concrete have this desirable thermal mass property, while wood and steel do not. For this reason, today, the use of masonry and concrete is highly promoted by these industries as sustainable materials.

While the current state of the art provides high thermal mass building materials, this property increases the weight and thickness of the exterior walls. These negative features limit the height of the structure and reduce the available floor space. A larger foundation is also required to support the higher weight of the walls. Further, masonry and concrete materials may absorb water, providing a fertile ground for mold growth or wearing away the integrity of the support.

What is needed is an efficient and effective method and apparatus for providing a structurally sound, energy savings wall for residential construction.

Therefore, it is a primary purpose of the present invention to improve over the state of the art.

It is a primary purpose of the present invention to utilize sustainable construction materials such as rolled steel or aluminum in a manner so as to provide a structure having high thermal efficiency.

It is a further purpose of the present invention to reduce the mass and footprint of the structural support while promoting high thermal efficiency.

It is a further purpose of the present invention to utilize transparent building materials so as to provide natural lighting for the interior of the structure.

It is a further purpose of the present invention to incorporate photovoltaic coating into the building materials in order to provide a sustainable source of electric power.

These and/or other objects, features, or advantages of the present invention will become apparent. No single embodiment of the present invention need achieve all or any particular number of the foregoing objects, features, or advantages.

SUMMARY

According to one aspect of the present invention a sustainable energy saving wall for use in residential construction is provided. The wall includes a structural frame constructed of a plurality of rolled steel (or aluminum) members, a transparent sheathing layer affixed to the structural frame members to support the frame against shear forces, a glazing layer consisting of configurations such as an insulating glass assembly having a pair of glass panes separated by a gas filled cavity wherein the glass panes are sealed together to provide an airtight seal and thermal resistance, a laminated glass unit or a monolithic glass unit, an aluminum glazing frame consisting of one or more aluminum pieces having gaskets for securely holding the glazing unit (insulated glass units, laminated glass, or monolithic glass), and the aluminum glazing frame is fastened to the structural frame (rolled steel or aluminum) members. In a preferred form, a photovoltaic coating is associated with at least one of the glass panes to provide a solar energy capturing and aesthetic component to the wall. The wall includes preferably a sheathing layer made of a transparent material such as, polycarbonate sheets, acrylic sheets, or any like appropriate transparent material and the photovoltaic coating being connected to an electricity generating device for producing solar power.

According to another aspect of the present invention, a method for constructing a residential building is disclosed. The method includes the steps of assembling a structural frame using a plurality of rolled steel or aluminum members, attaching a transparent sheathing member commensurate in size with the frame, arranging a plurality of the adjacent frames to form an exterior surface, attaching the adjacent frames to one another, fastening a first piece of aluminum glazing frame member (mullion) to each of the structural frame members, positioning atop the first piece of the aluminum glazing frame member a glazing unit consisting of configurations such as an insulating glass unit comprising a pair of glass panes defining a cavity filled with a gas to increase the thermal resistance of the insulating glass unit, laminated glass unit, or monolithic glass unit, and affixing a second piece of the aluminum glazing frame member (pressure plate) to the first aluminum piece to hold the glazing unit used in place by compressive forces. In a preferred form, the method includes the insulating glass units or other glazing configurations used having one or more photovoltaic coatings to provide an energy capturing and aesthetic component to the residential building and the sheathing member being a polycarbonate sheet. In a further preferred form, the method optionally includes translucent insulation between the transparent sheathing and glazing unit used to provide extra thermal insulation if so desired.

DETAILED DESCRIPTION

The present invention is directed towards apparatuses and methods for providing a structurally sound, energy saving wall system for residential construction.

A sustainable energy saving wall system is accomplished through the innovative use of recyclable materials such as steel, aluminum, and glass to provide a thermally efficient home construction which decreases the need for heating, cooling, and electric lighting. Photovoltaic elements may be incorporated into the wall, allowing for electricity production during daylight hours. In residential construction, a number of these walls are connected so as to provide support to the structure. No additional structural support is necessary since the wall system is load-bearing. Use of rolled steel as a building material allows for supports to be spaced wider without sacrificing support.

Figure 1:
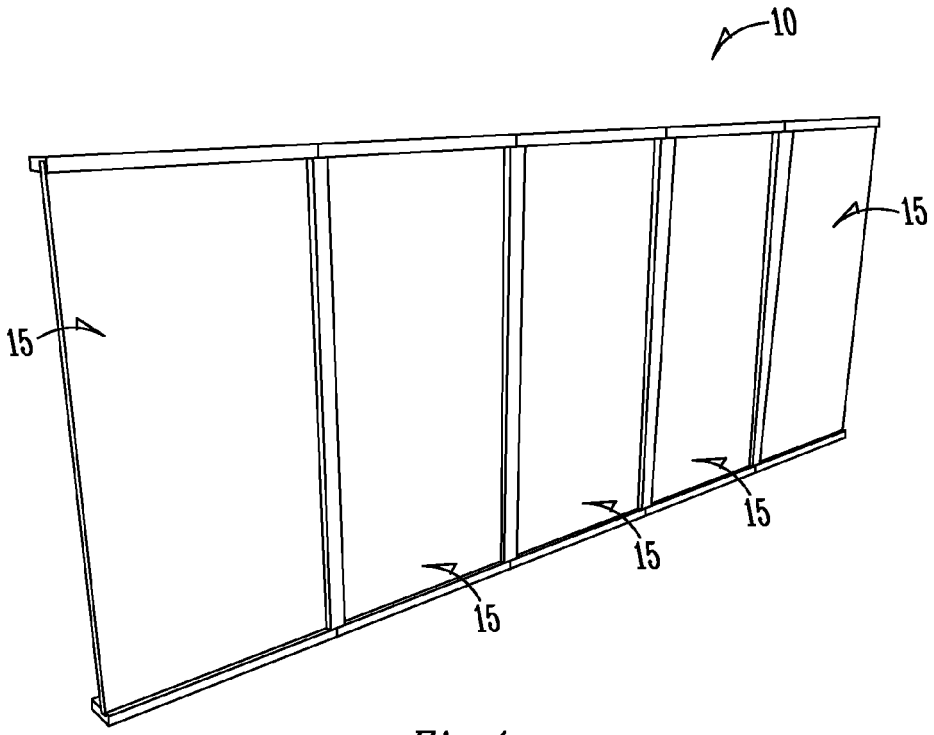
FIG. 1 is a perspective view of an embodiment of the invention.

Considering FIG. 1, there is shown an exemplary embodiment of the present invention. This view shows a sustainable energy saving wall system 10 formed by a series of connected wall panels 15 so as to provide support to a structure.

Figure 2:
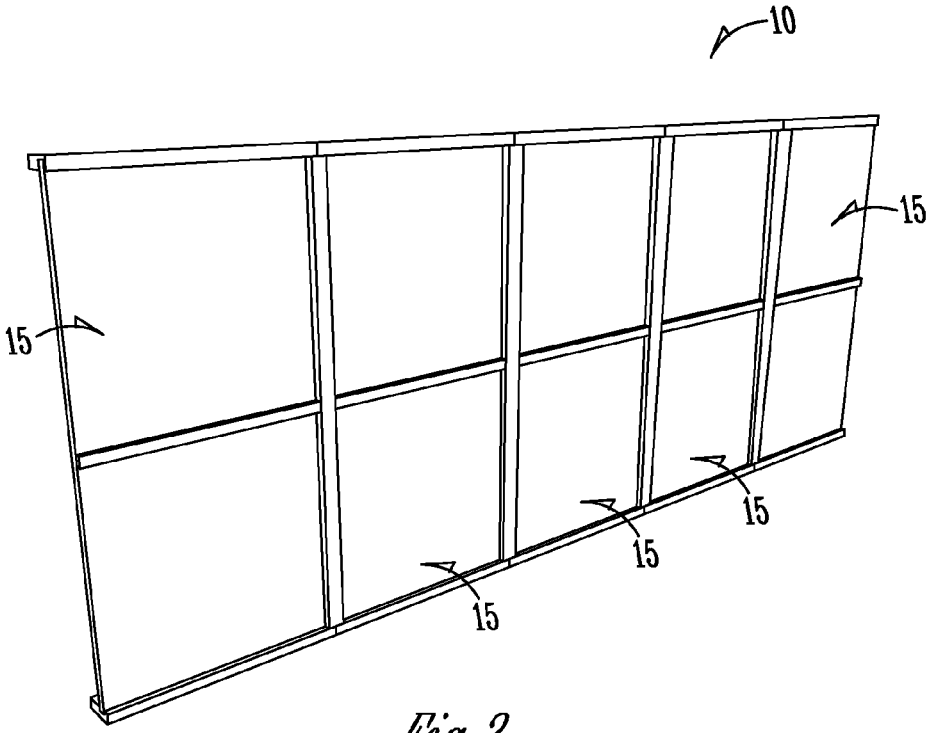
FIG. 2 is a perspective view of an alternative embodiment of the invention.

Turning to FIG. 2, there is shown a sustainable energy saving wall system, according to an alternative embodiment, where individual transparent energy saving panels 15 are attached to one another in order to provide support for a residential structure.

Figure 3:
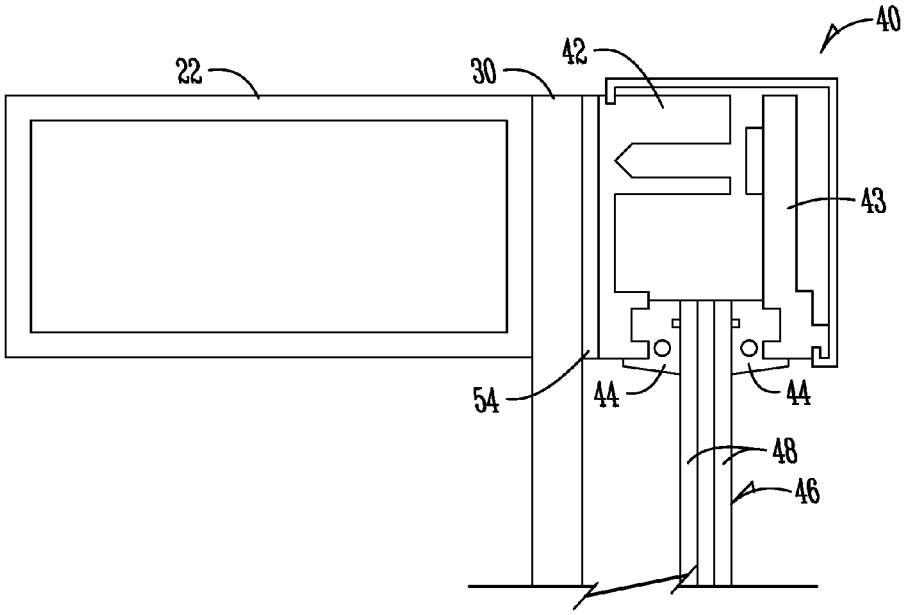
FIG. 3 is a horizontal sectional view of the wall system taken along line 3-3 in FIG. 2.

FIG. 3 shows a horizontal sectional view of the wall system according to an embodiment of the invention. Each panel 15 includes a structural frame 20 fabricated from a material suitable for load bearing, such as steel, aluminum or another sufficiently strong load bearing material. A rolled steel member 22, comprising part of a structural frame (not shown), provides support for a sheathing 30, here comprised of a sheet of transparent polycarbonate. Frame 20 provides a load bearing function as well as a back-up support system for out-of-plane wind loads. Frame member 22 is not limited to rolled steel. The present invention contemplates various types of material for frame member 22. In another embodiment frame member 22 may be an aluminum frame member as shown and illustrated in FIG. 16. Structural steel is available in a variety of shapes and sizes, and with several different grades and material properties. One type of structural steel is hollow structural section (HSS), which is typically of rectangular or circular cross-section. HSS sections are especially efficient for use as columns that experience axial and flexural loads because they have favorable bi-axial strength and are not as susceptible to lateral-torsional-buckling. HSS sections are created by different methods, depending on the size of the member and the manufacturer. In general, the production begins with flat steel sheets and then a series of processes that include press-breaking, cold working, and welding is applied to form the final product. As an alternative to steel, aluminum is also an option for frame member 22 as previously indicated. In an embodiment of the present invention, aluminum frame members 22 may be extruded to include mullions as well, thus reducing the number of pieces that need to be assembled. Aluminum frame members 22 are suitable for an embodiment of the present invention where frame member 22 is prefabricated before shipment to where the wall 10 is assembled.

Those skilled in the art can also appreciate that the transparent sheathing component may include materials other than polycarbonate. For example, other transparent materials may include, but are not limited to acrylic. Polycarbonate is a thermoplastic polymer that has a variety of uses ranging from architectural glazing to compact discs. It is sold under various trade names such as MAKROLON (Bayer Corp/Sheffield Plastics), CALIBRE (Dow Chemical), LEXAN (GE Plastics), and TRISTAR (PTS). Polycarbonate is significantly stronger than both acrylic plastic and glass. As such, polycarbonate may be used in glazing applications where high impact strength may be required. In addition to its high impact strength, a polycarbonate sheet is about half the weight of a similar size glass sheet, thus reducing transportation and installation costs. Polycarbonate sheets are available in a variety of grades and surface treatments that affect its strength, durability, and UV resistance. Some general material properties for standard Makrolon polycarbonate are listed in the Table 1, below.

TABLE 1

| | |
|---|---|
| Thermal Expansion | 0.0000375 in/in F |
| Tensile Strength (ultimate) | 9500 psi |
| Shear Strength | 6000 psi |
| Compressive Strength | 12500 psi |
| Light Transmittance (⅛" clear sheet) | >88% |

The sheathing provides support for the rectangular structural frame 20 against in-plane shear loads, which would otherwise tend to collapse the frame without the sheathing 30. Attached to frame 20 is a glazing frame 40 that in one embodiment includes a first glazing frame member 42 (otherwise known in the art as a mullion base plate) which may incorporate a protective layer 54 between the first piece 42 and the sheathing 30. In one embodiment, first glazing frame member 42 may be an aluminum material. This first glazing frame member 42 also incorporates a gasket 44. A second glazing frame member 43 (otherwise known in the art as a pressure plate), also incorporates a gasket 44, and attaches to the first piece 42 through a fastening means, such as a screw, magnet, clip or other fastener. In one embodiment, second glazing frame member 43 may be an aluminum material. The gaskets 44 on the first and second frame members 42 and 43 are aligned to protectively hold between them a glazing unit 46. The glazing unit 46 may include as separate embodiments of the present invention an insulated glass unit, a monolithic glass unit or a laminated glass unit. Glazing frame 40 could be constructed of aluminum, steel, high strength wood, or any other suitable glazing frame materials known by those skilled in the art. The glazing unit generally includes a pair of glass panes 48 defining a cavity 50, preferably filled with an insulating gas such as argon. An insulting glass unit, commonly referred to as IGU or double (or triple) pane glass, are commercially available and often consist of two or more lites (panes) of glass that enclose a sealed air space. The IGU offers an increase in performance over standard glazing because the sealed air space reduces heat gain, heat loss, and sound transmission. Performance of an IGU can be further increased by filling the sealed air space with heavy gases such as krypton and argon, which have higher thermal resistance than air, or by applying low-E coatings to the glass surfaces. Also shown is a snap-fit cover 45 which provides aesthetic features by covering the second glazing frame member 43 from view.

Figure 4:
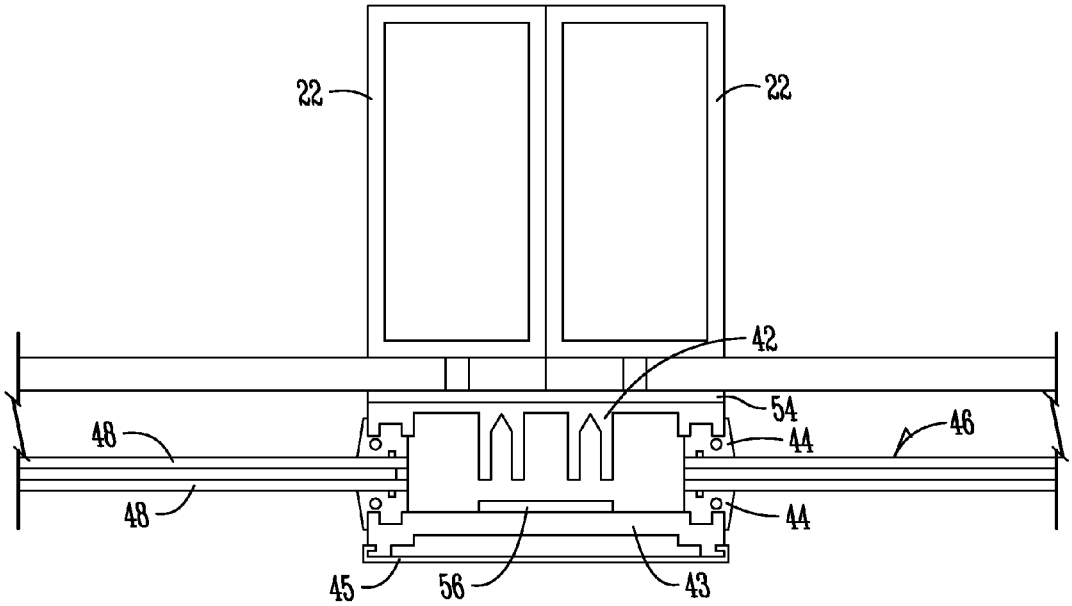
FIG. 4 is a vertical sectional view of the wall system taken along line 4-4 in FIG. 2.

FIG. 4 shows a vertical sectional view of a frame member 22 according to an embodiment of the present invention forming a part of the sustainable energy saving wall system 10. FIG. 4 shows the point of interaction between two adjacent sustainable energy saving wall panels where two steel frame members 22 meet to make a wall of joined panels. As shown in this illustration, each sustainable energy saving panel or the wall 10 comprises a sheathing 30 consisting preferably of a transparent polycarbonate sheet and a frame member 22. The first glazing frame member (mullion) 42 engages a portion, typically an edge portion, of both sheathing elements 30 and incorporates a pair of gaskets 44 for holding a glazing unit 46. Gaskets 44 are compressed against units 46 by securing second glazing frame member (pressure plate) 43 to first member 42. In a preferred form, glazing frame members 42 and 43 are aluminum glazing frame members. A decorative snap-fit cover 45 is also shown. Snap cover 45 preferably attaches to second member 43 for hiding components that attach sheathing 30 and glazing unit 46 to frame member 22.

Figure 5:
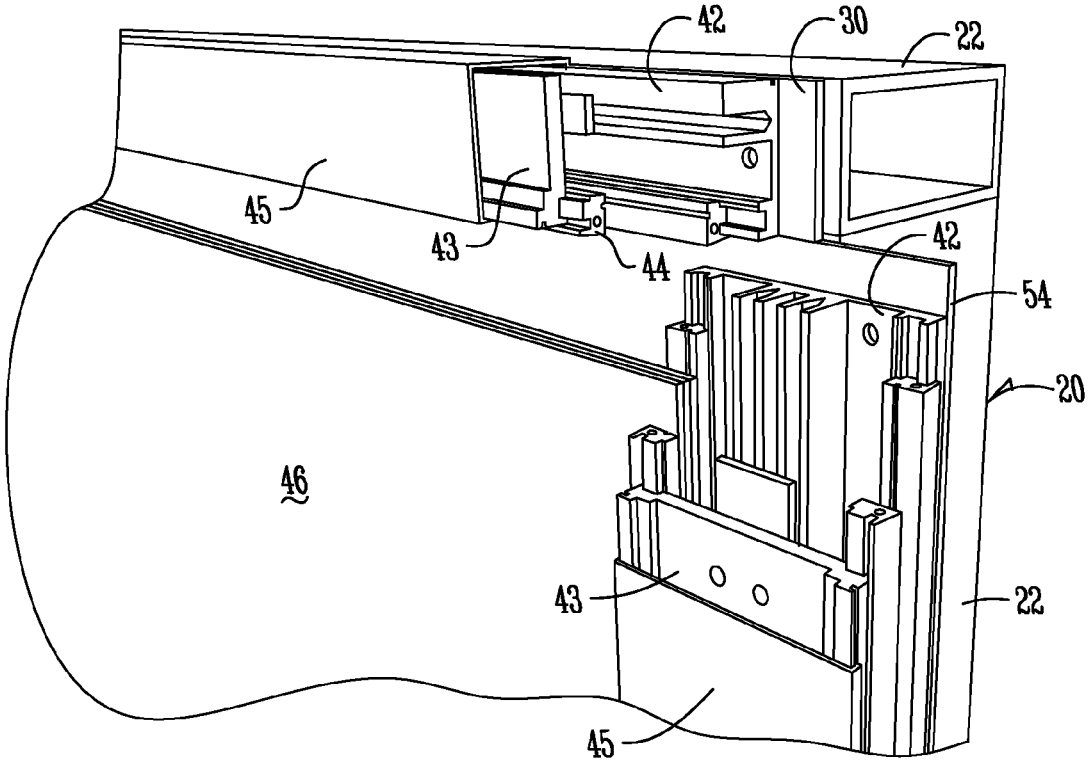
FIG. 5 shows a corner cutaway of the wall system.

FIG. 5 shows a cutaway view of the first and second glazing frame member 42, 43 and their attachment to an insulating glass unit 46 and frame members 22. FIG. 5 also illustrates the attachment of sheathing 30 to frame members 22 for forming a panel 15 of wall 10. In one embodiment, support and load bearing is provided by a structural frame 20 consisting of a plurality of rolled steel members 22 and a transparent sheet of polycarbonate sheathing 30 fixed to the rolled steel members 22. A first glazing frame member (mullion) 42 are fastened to the rolled steel member 22 through the sheathing 30 about the perimeter of the structural frame 20. An insulated glass unit 46 having a predetermined size so as to fit the perimeter formed by the first glazing frame members 42 is then placed atop the gaskets 44 incorporated into the first glazing frame member 42. Finally, second glazing frame member 43 having gaskets 44 are placed about the perimeter of the rolled steel frame and secured to first members 42. The glazing unit 46 is held in place by compressive force between the gaskets 44 of the first piece 42 and second members 43.

Figure 6:
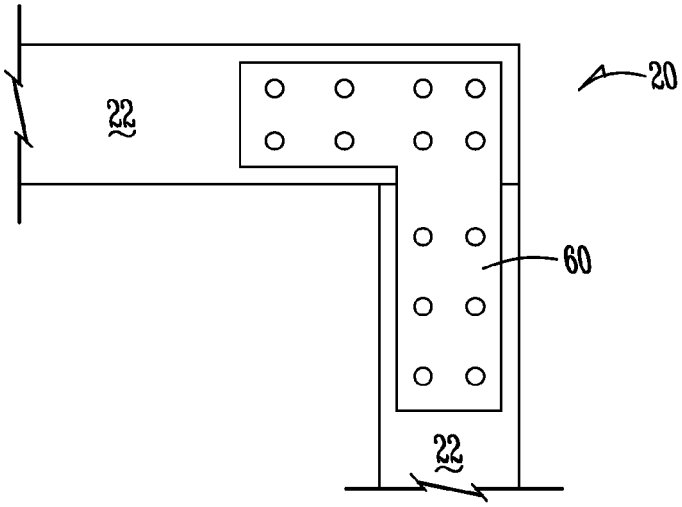
FIG. 6 shows an embodiment for joining horizontal and vertical structural frame members according to an exemplary aspect of the present invention.
Figure 7:
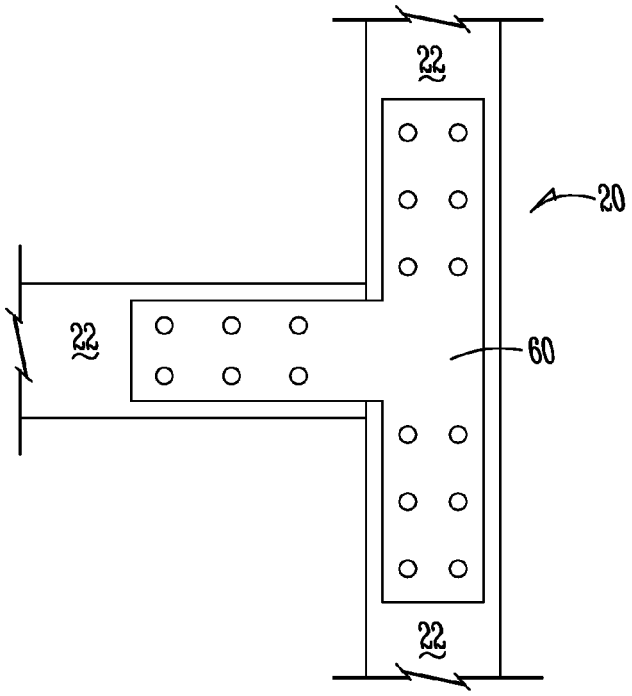
FIG. 7 shows another embodiment for joining horizontal and vertical structural frame members according to an exemplary aspect of the present invention.

FIGS. 6-10 illustrate structural frame member-to-frame member or panel-to-panel connection options for the wall 10. One embodiment includes joining HSS rectangular tubes into a rectangular frame with an intermediate horizontal rectangular tube at mid-height and another includes joining at the ends. Each individual structural frame panel 15 may be approximately 8' tall by 4' wide (depending upon the available size of polycarbonate sheathing 30) for prefabricated panels, although other panel sizes can also be used based on architectural and structural engineering design. Structural frame 20 carries the vertical gravity loads associated with the floor and roof systems above the wall and the out-of-plane lateral forces associated with wind loading. In-plane lateral loads are primarily resisted by sheathing 30 fastened directly to structural frame 20 (much like plywood or OSB sheathing in a traditional wood frame wall). Frame members 22 of structural frame 20 may be assembled in a variety of ways, as shown in FIGS. 6-10. In the preferred embodiment, as shown in FIG. 6 and FIG. 7, a gusset plate 60 is used to attach two frame members 22 together. Gusset plate 60 may be either "L" shaped so as to join two frame members 22 together at a corner, or "T" shaped so as to join two frame members 22 at a midpoint. Accordingly, gusset plate 60 is adapted to securely attach frame members 22 to form structural frame 20. Gusset plates 60 may be secured to structural frame members 20 using various attachment means known in the art, such as for example, screws, welds, adhesive, or rivets.

Figure 8:
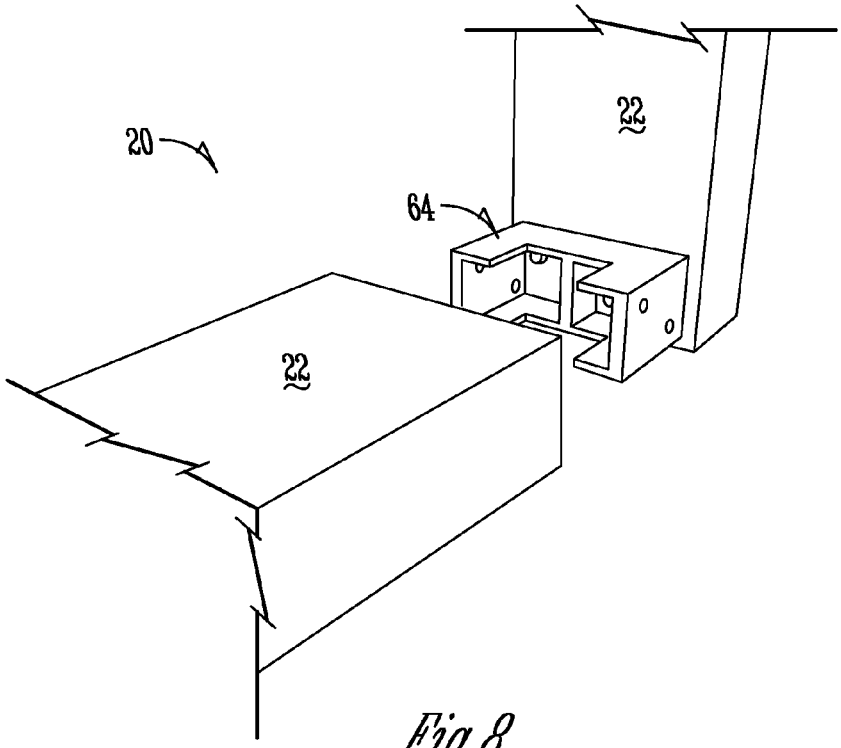
FIG. 8 shows embodiment for joining horizontal and vertical structural frame members according to an exemplary aspect of the present invention.

An alternative method of attaching frame members 22 to form structural frame 20 is shown in FIG. 8. A shear block 64 sized so as to fit within another frame member 22 is attached to one frame member 22. A second frame member 22 is placed about shear block 64 and fastened thereon. This alternative means of fastening frame members 22 to create structural frame 20 has the advantage of presenting a flat surface as frame member 22 as holes for screws may be countersunk.

Figure 9:
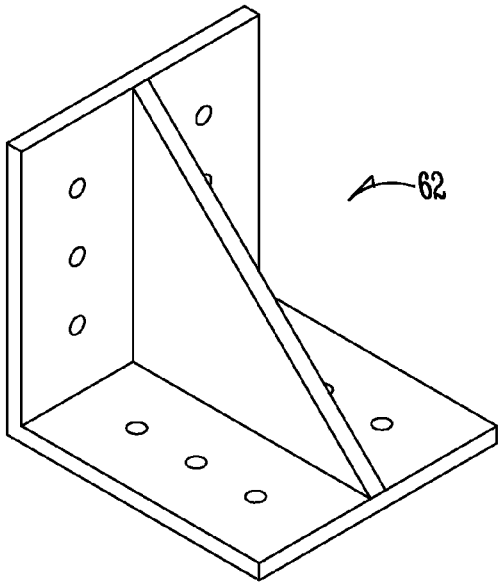
FIGS. 9-10 show a structural frame stiffener according to an embodiment of the present invention.
Figure 10:
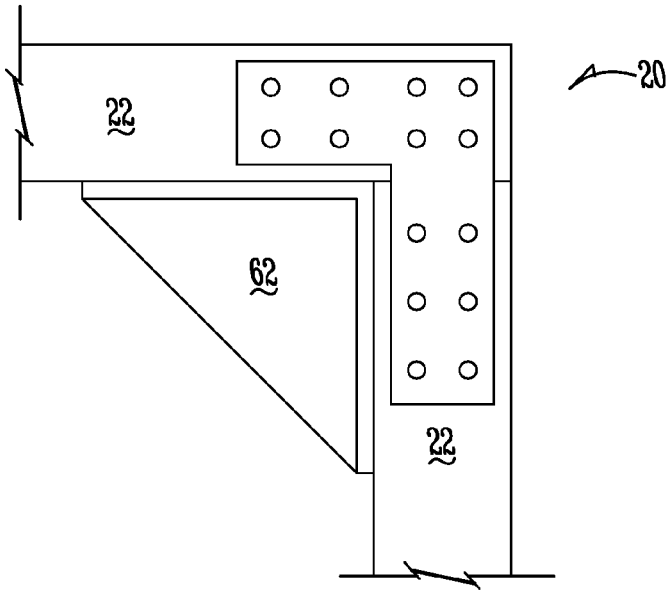

In high seismic regions where large lateral resistance capacity is needed, a frame stiffener, such as stiffener 62 shown in FIGS. 9-10, may be used to provide additional lateral load resistance and ductility. Frame stiffener 62 is shown generally in FIG. 9. Frame stiffener 62 is positioned at the intersection of two frame members 22 so as to provide an increased resistance to shear forces and lateral loading acting on structural frame 20 (see FIG. 10). These shear forces are normally prevented through the use of sheathing 30, but in areas where the shear force can be especially high, such as high seismic regions, frame stiffeners 62 may be added to increase the resistance to these forces.

Figure 11:
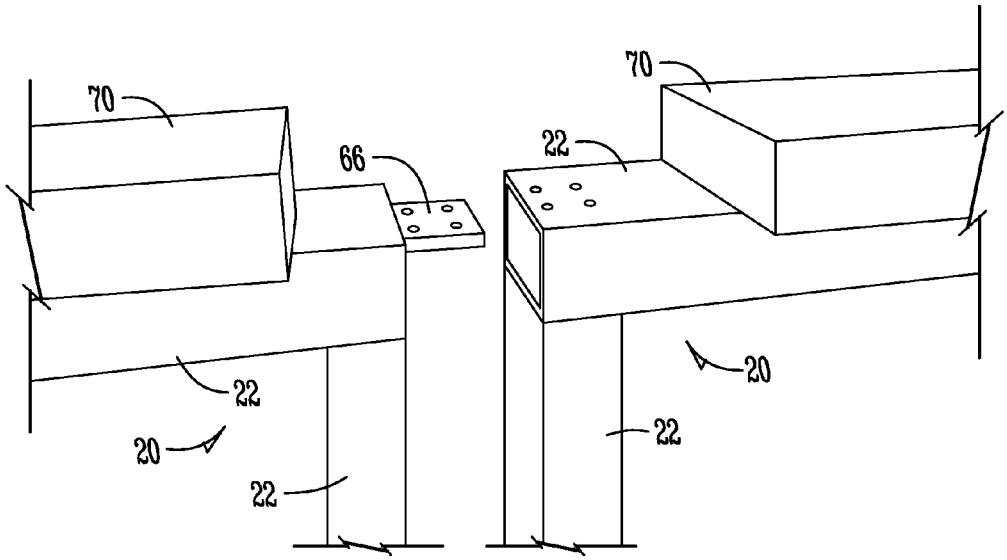
FIG. 11 illustrates an embodiment for joining adjacent structural frames according to an exemplary embodiment of the present invention.
Figure 12:
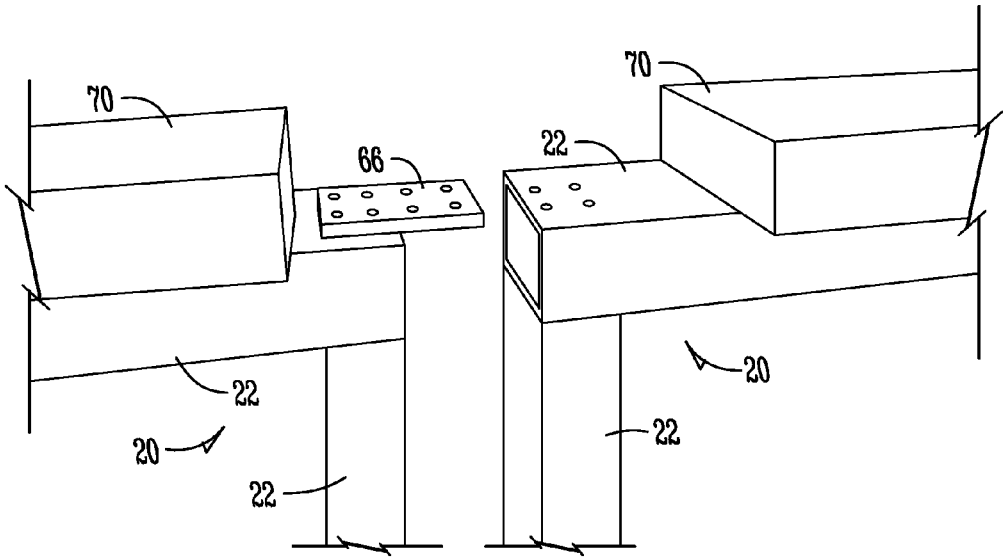
FIG. 12 shows an alternative embodiment for joining adjacent structural frames according to an exemplary embodiment of the present invention.
Figure 13:
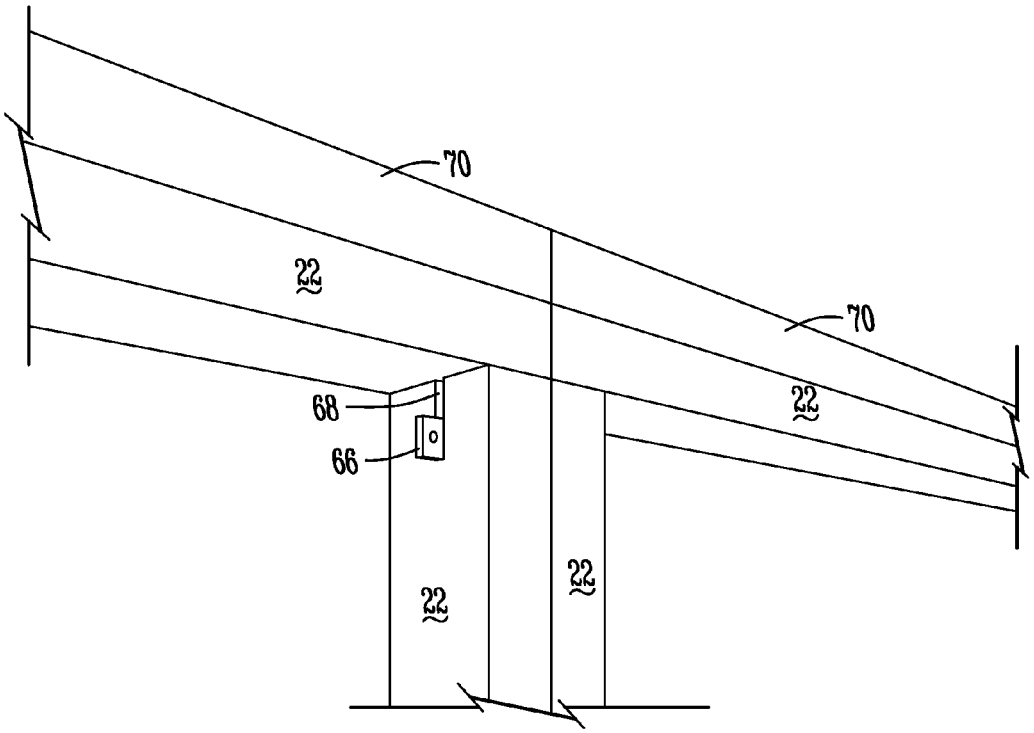
FIG. 13 illustrates another embodiment for joining adjacent structural frames according to an exemplary embodiment of the present invention.

FIGS. 11-13 disclose a variety of means for joining structural frames 20 together to form wall 10. In one embodiment, a connector plate 66 having a pattern of holes aligning with a pattern of tapped holes on a first structural frame 20 is used. Screws are inserted through the connector plate 66 and secured into the first structural frame 20. A second structural frame 20 is placed beside the first, and screws are inserted through the connector plate 66 into the second structural frame 20, thereby securing the steel frames together. Alternatively, the tapped holes may be located on the connector plate 66 and through holes may be located on structural frames 20 so that the connector plate 66 is located inside frame member 22 defining the top of structural frame 20.

As shown in FIG. 11, an alternative method of connecting structural frames is through the use of a factory installed connector plate 66 welded to a frame member 22 of a first structural frame 20. Upon installation, the connector plate 66 needs only to be secured to a frame member 22 of a second structural frame 20 to complete installation. The connector plate 66 may be secured to the second structural frame 20 through welding, screws, rivets, or other commonly known methods.

Another embodiment of the connection is shown in FIG. 13. According to this embodiment, a connector plate 66 attached to one frame member 22 slides through a slot 68 in an adjoining frame member 22. A pin connector is then inserted through a hole in the connector plate 66, preventing the structural frames 20 from moving relative to one another and to connect frames 20 together to form wall panel 10. Alternatively, slots may be formed through adjoining frame members 22 whereby connector plate 66 extends through both the adjoining frame members 22 and is pinned at its ends to secure structural frames 20 together.

Structural frame 20 for forming wall panel 10 may be prefabricated in a shop and shipped to the construction site as individual frame units. Alternatively, structural frame 20 may be fabricated at the construction site. Whether prefabricated at the shop or fabricated at the job site, structural frames 20 are installed on supporting foundation or floor and connected to the adjacent structural frame units using one of the discussed connection options illustrated in FIGS. 14-15.

Figure 14:
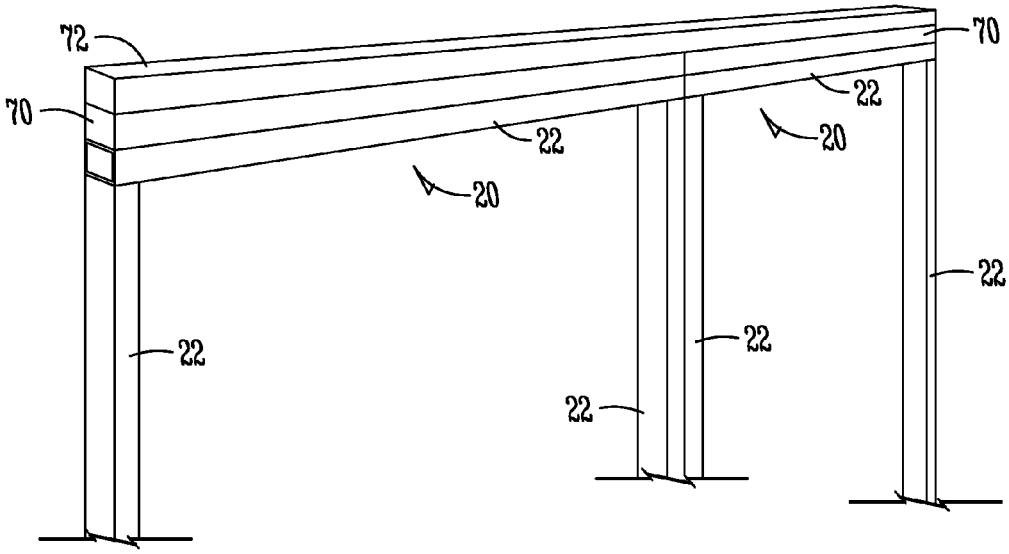
FIG. 14 shows two adjacent structural frames attached to a wood nailer and top sill plate according to an embodiment of the present invention.
Figure 15:
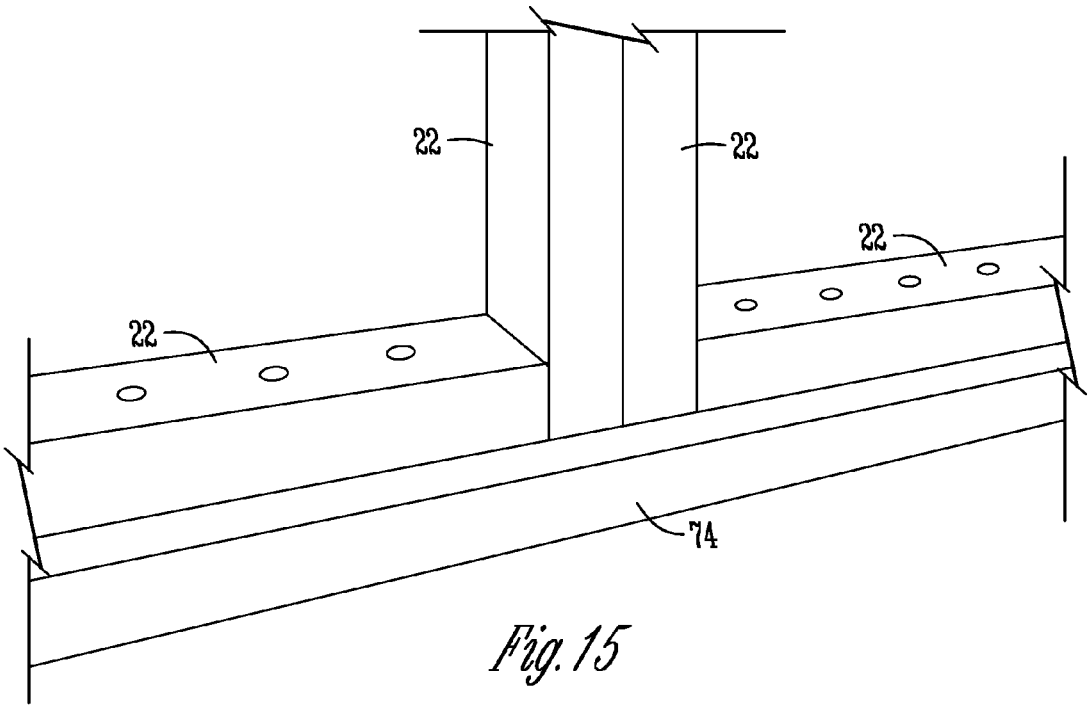
FIG. 15 illustrates an embodiment for joining structural frames to a sill plate according to an exemplary embodiment of the present invention.

FIGS. 14-15 illustrate one embodiment for incorporating or integrating embodiments of the present invention into existing construction. As shown in FIG. 14, a wood nailer 70 is installed to the top of frame member 22 of structural frame 20. A sill plate 72 may then be installed at the construction site, bridging the wood nailers 70 of a plurality of structural frames 20 for forming wall panel 10. Top sill plate, 72 will typically be a 2×4 or 2×6 lumber, and will likely be installed by the contractor directly above the wood nailer on top of structural frame units to provide further continuity as well as a tie-in for the adjoining floor/wall systems. In this manner, the steel frame construction may be integrated into existing residential constructions, or may be incorporated into a new residential construction utilizing traditional building materials and methods.

To provide system continuity and allow for integration with other wall systems (i.e. traditional wood frame walls), structural frames 20 will typically be installed on top of a continuous wood 2×4 or 2×6 base sill plate 74 and connected to sill plate 74 with site-installed fasteners directly through the bottom frame member 22. To mate structural frame 20 or frame member 22 to the bottom sill plate 74, a plurality of holes are drilled through the bottom frame member 22 during fabrication of structural frame 20. These holes accommodate a plurality of screws for securing the structural frame 20 to the bottom sill plate 74. In this manner, the invention may interact with existing residential structures or those utilizing conventional building materials and methods.

Figure 16:
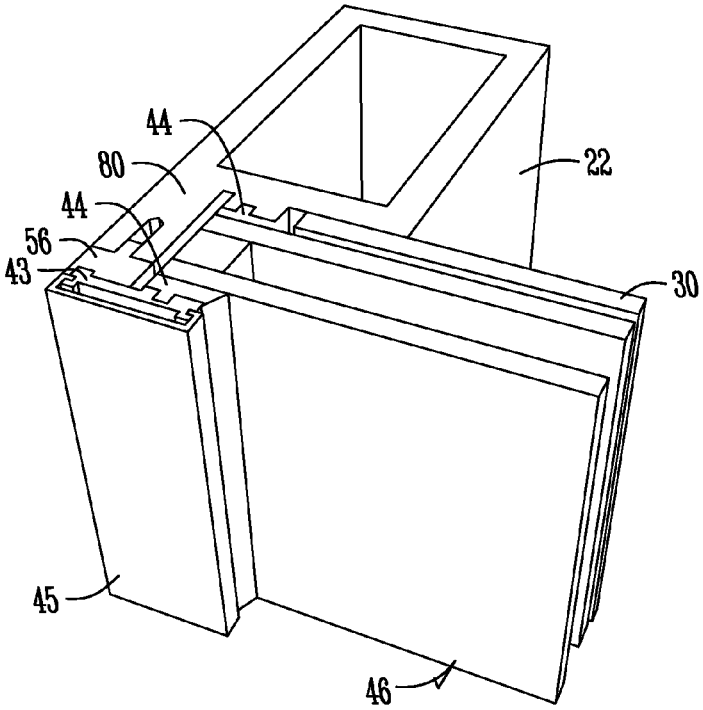
FIG. 16 illustrates another embodiment of the present invention.
Figure 17:
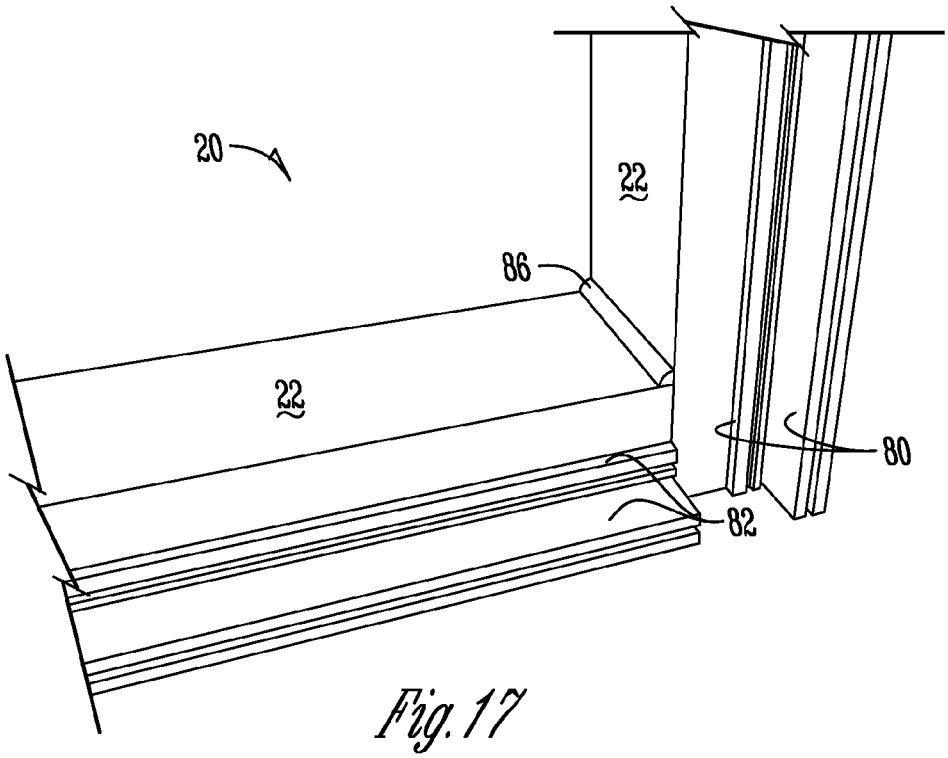
FIG. 17 illustrates an embodiment for joining structural framing members according to an exemplary embodiment of the present invention.
Figure 18:
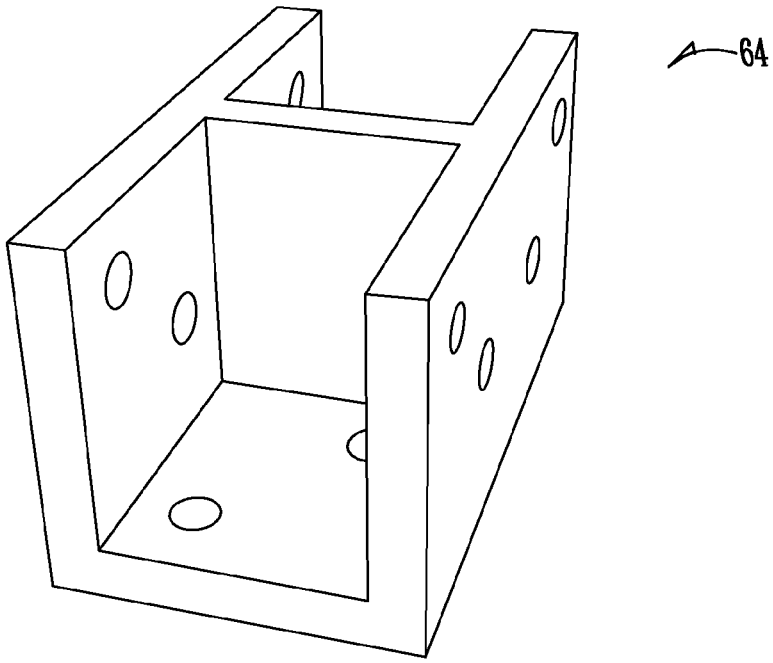
FIGS. 18-20 illustrate another embodiment for joining structural framing members according to an exemplary embodiment of the present invention.
Figure 19:
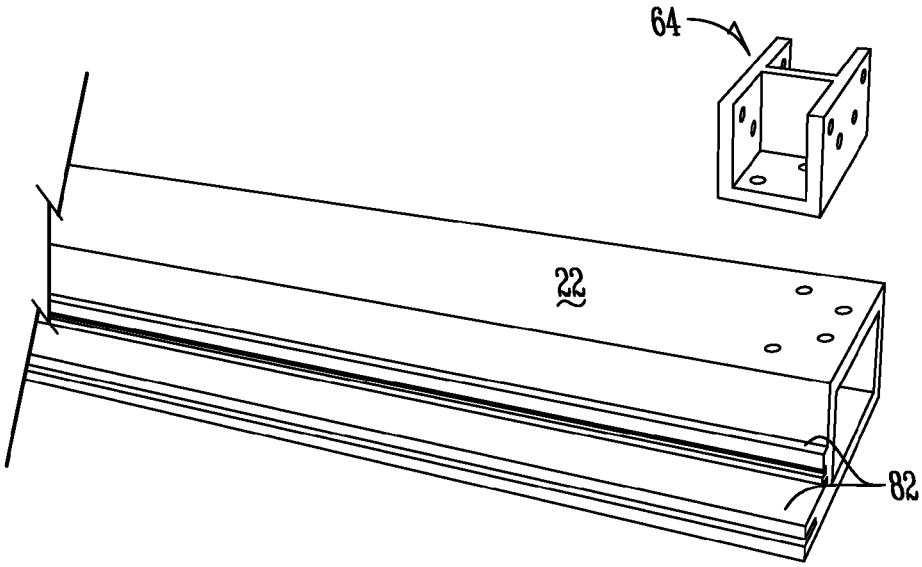
Figure 20:
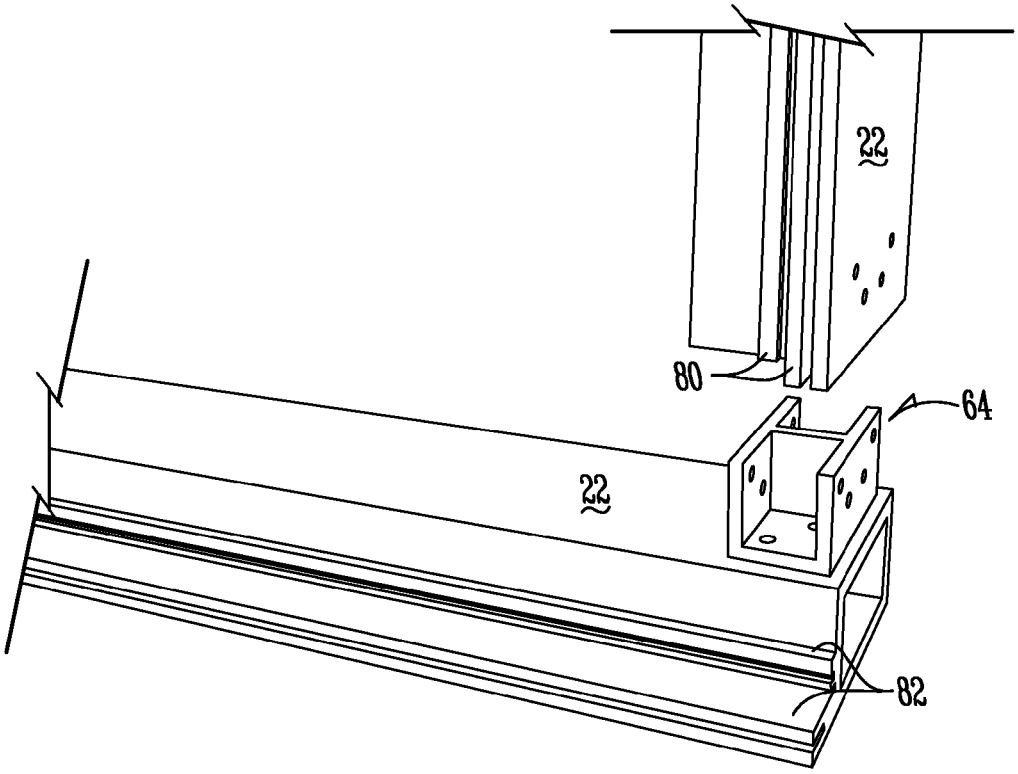
Figure 21:
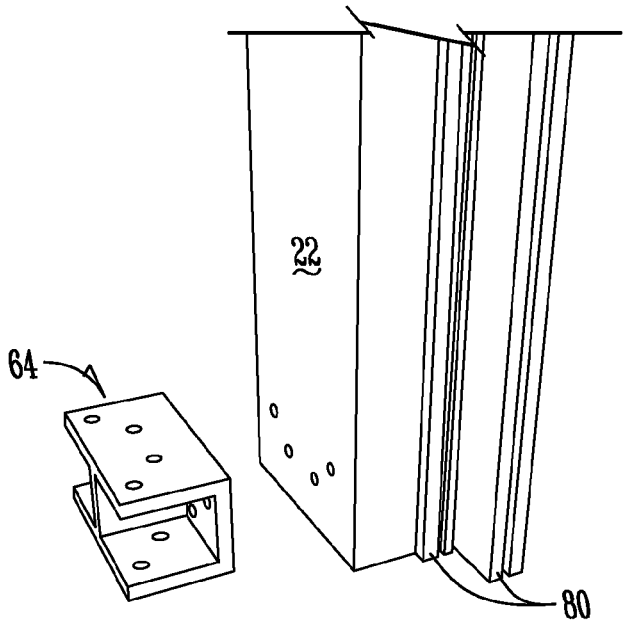
FIGS. 21-22 illustrate another embodiment for joining structural framing members according to an exemplary embodiment of the present invention.
Figure 22:
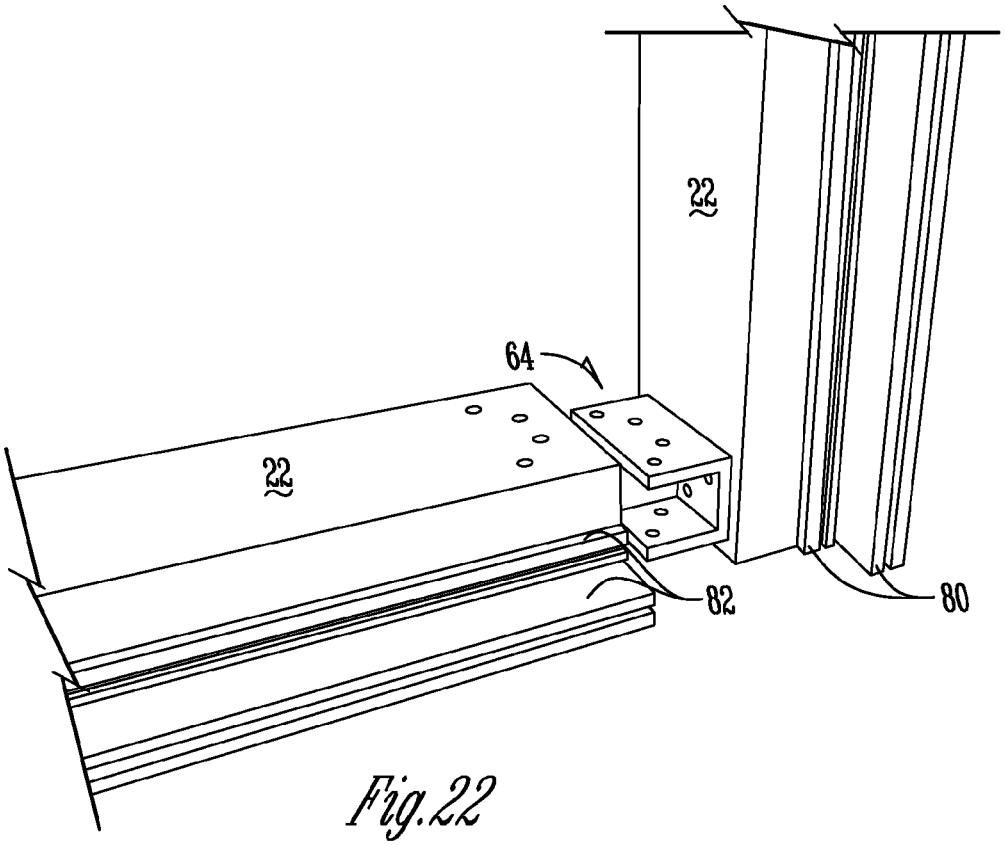
Figure 23:
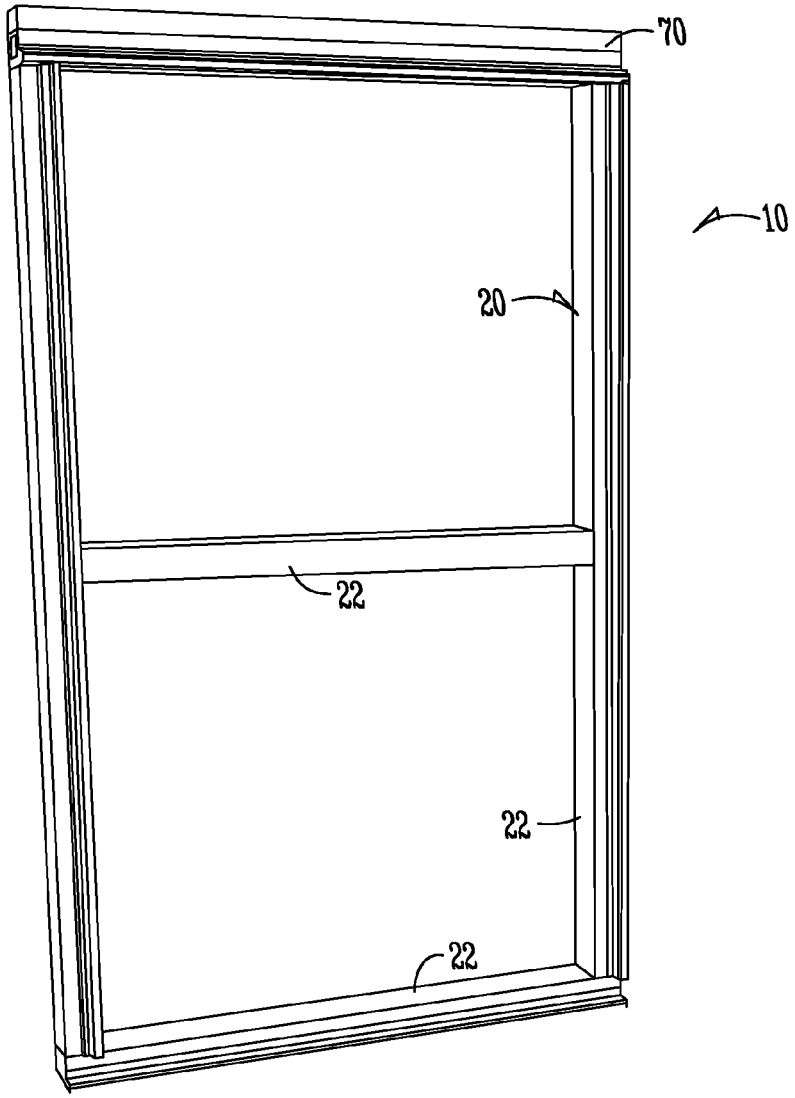
FIG. 23 illustrates an assembled panel according to an exemplary aspect of the present invention.

FIGS. 16-29 illustrate another embodiment of the present invention. As previously indicated, the present invention contemplates that frame members 22 may be joined together to form a plurality of structural frames 20, which are subsequently joined together to form an embodiment of the energy saving wall system 10 of the present invention. Complete prefabrication of wall panel 10 may occur before or prior to shipment to the construction site. During prefabrication, frame members 22 may be joined together with sheathing 30 and glazing unit 46 to form wall panel 10. FIG. 16 illustrates one embodiment of a prefabricated unit according to an exemplary embodiment of the present invention. Although the following description and drawings discuss and describe a prefabricated unit, the present invention contemplates that the following embodiments may be fabricated on site as well. Like previous embodiments, wall panel 10 includes an extruded structural member. The extruded structural member is preferably a frame member 22 as previously described. Frame member 22 preferably is an extruded aluminum structural frame member. However, the present invention contemplates that frame member 22 may be constructed from various types of material, including but not limited to, materials such as steel, aluminum and other sufficiently strong and rigid materials capable of forming a frame member. As shown in FIG. 16, frame member 22 is an extruded aluminum member. Integrated into frame member 22 is a mullion 80. Mullion 80 includes columns of varying depth extending outward from frame member 22 to provide connection points for securing sheathing 30, glazing unit 46, and second member (pressure plate) 43 to frame member 22. In a preferred form, mullion 80, frame member 22 and second glazing frame member 43 are fabricated of aluminum. One embodiment of structural frame 20 may include sheathing 30 attached to frame members 22 forming structural frame 20. As previously indicated, sheathing 30 is preferably a polycarbonate material, however, may also be an acrylic or other type of transparent material. Glazing unit may be of the type that is commercially available or fabricated, such as an insulated glass unit, a monolithic glass unit or a laminated glass unit. Glazing unit 46 may be received between gaskets 44. Glazing unit 46 and thermal brake 56 are sandwiched between mullion 80 and second member 43. Second member 43 is attached to mullion 80 preferably using screws, however, alternative means for securing second member 43 to mullion 80 of frame member 22 are contemplated, which include but are not limited to, rivets, anchors, bolts, nails, or other connective means. To provide a clean aesthetic appearance, cover 45 hides second member 43 by snapping around in covering relation to second member 43. Prior to joining sheathing 30, glazing unit 46, and other necessary components associated with mullion 80 and frame members 22 are connected together to form structural frame 20. FIGS. 17-22 illustrate various embodiments for joining frame members 22 together for forming structural frame 20. FIG. 17 illustrates one embodiment wherein frame members 22 are joined together using a weld connection thereby aligning mullion 80 on vertical frame member 22 with mullion 82 on horizontal frame member 22. Welding frame members 22 together provides one embodiment for joining frame members 22 to form structural frame 20 according to an exemplary embodiment of the present invention. FIGS. 18-22 illustrate another embodiment for joining frame members 22 to form structural frame 20. In FIG. 18, a shear block 64 is generally shown. Shear block 64 may be attached to either ends of a vertical or horizontally oriented frame member 22. In the case where shear block 64 is attached to a horizontally oriented frame member 22 (as illustrated in FIG. 19), a vertical frame member 22 may be positioned over top shear block 64 so that vertical frame member 22 fits over top shear block 64 (see FIG. 20) to allow vertical and horizontal frame members 22 to be connected together so that one is flush with the other. Alternatively, shear block 64 may be mounted at the end to a vertical frame member 22 (see FIG. 21), whereby a shorizontal frame member 22 is secured to vertical frame member 22 by inserting shear block 64 into the horizontal frame member 22 whereby the end of frame member 22 butts up against and is flush with the surface to which shear block 64 is mounted on vertical frame member 22. Shear block 64 may be attached to frame member 22 using attachment means known in the art. For example, shear block 64 may be attached to frame member 22 using screws, rivets, welding, adhesive, anchors, bolts, or other attachment means. Like the previous embodiment illustrated in FIGS. 1-16, structural frame 20 may receive on the vertical-most horizontal frame member 22, wood nailer 70 for incorporating or integrating structural frame 20 into other wall systems, such as a traditional wood frame wall.

Figure 24:
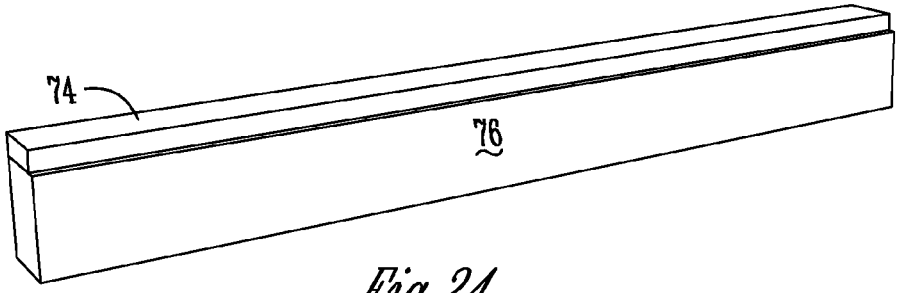
FIGS. 24-25 illustrate an embodiment for joining the assembled panel shown in FIG. 23 to a foundation or floor system according to an exemplary aspect of the present invention.
Figure 25:
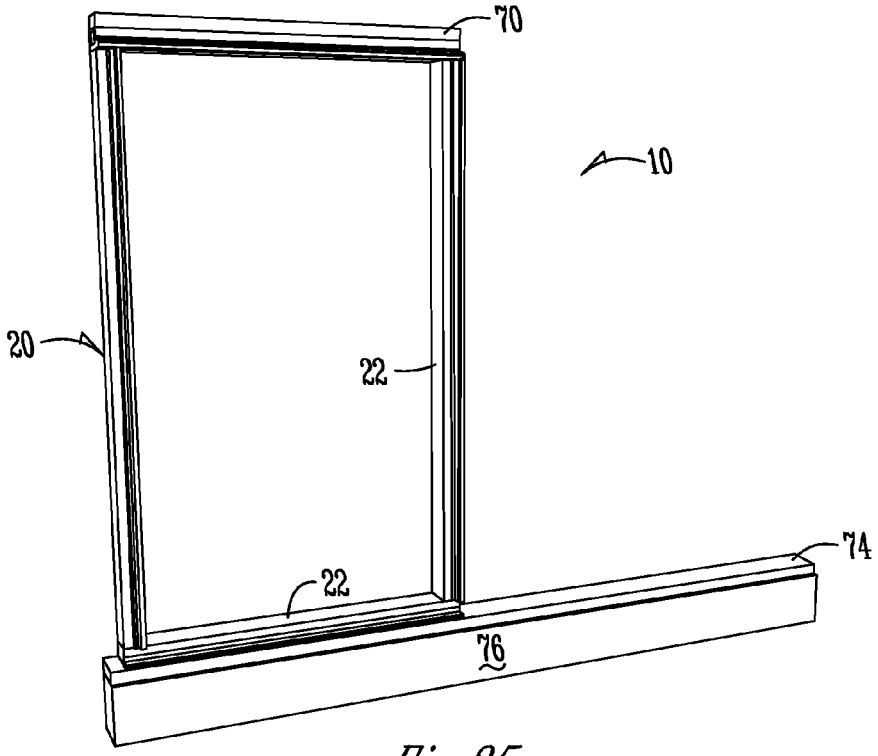
Figure 26:
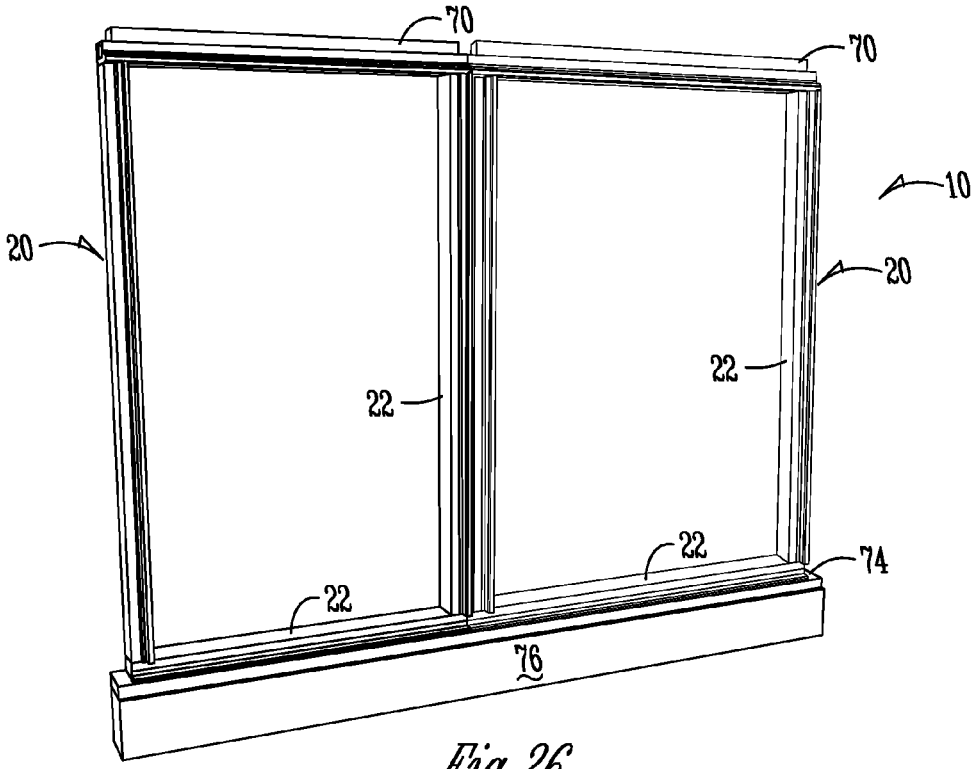
FIGS. 26-29 illustrate an embodiment for joining adjacent panels according to an exemplary embodiment of the present invention.
Figure 27:
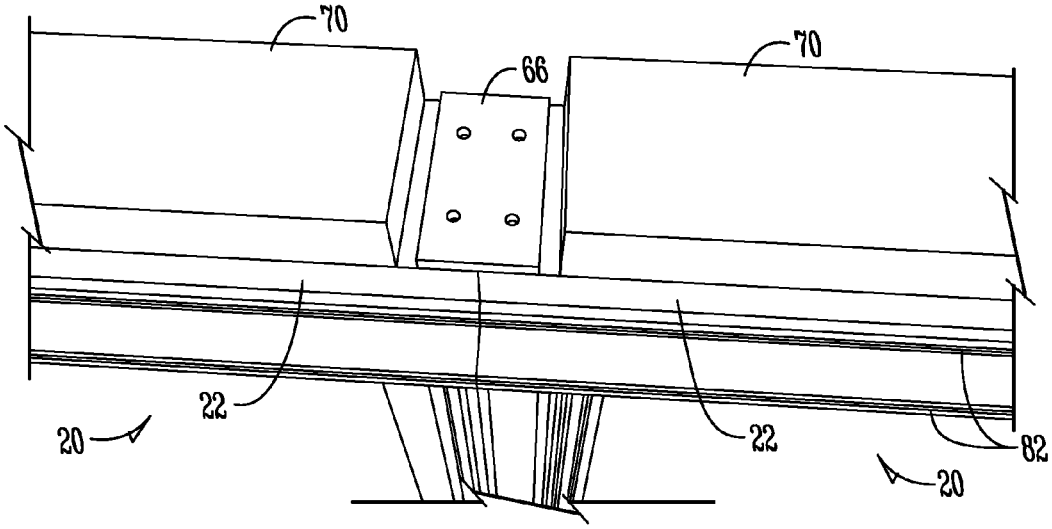
Figure 28:
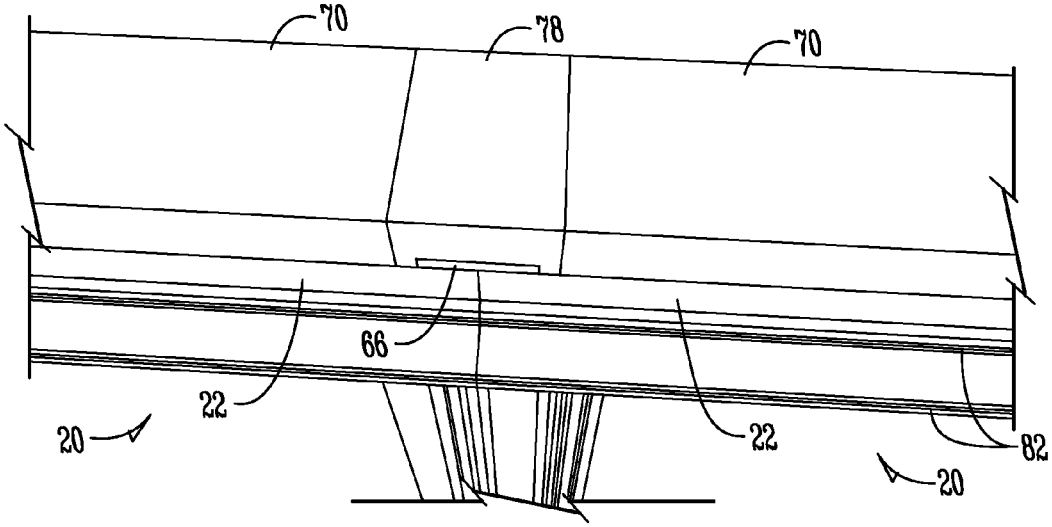
Figure 29:
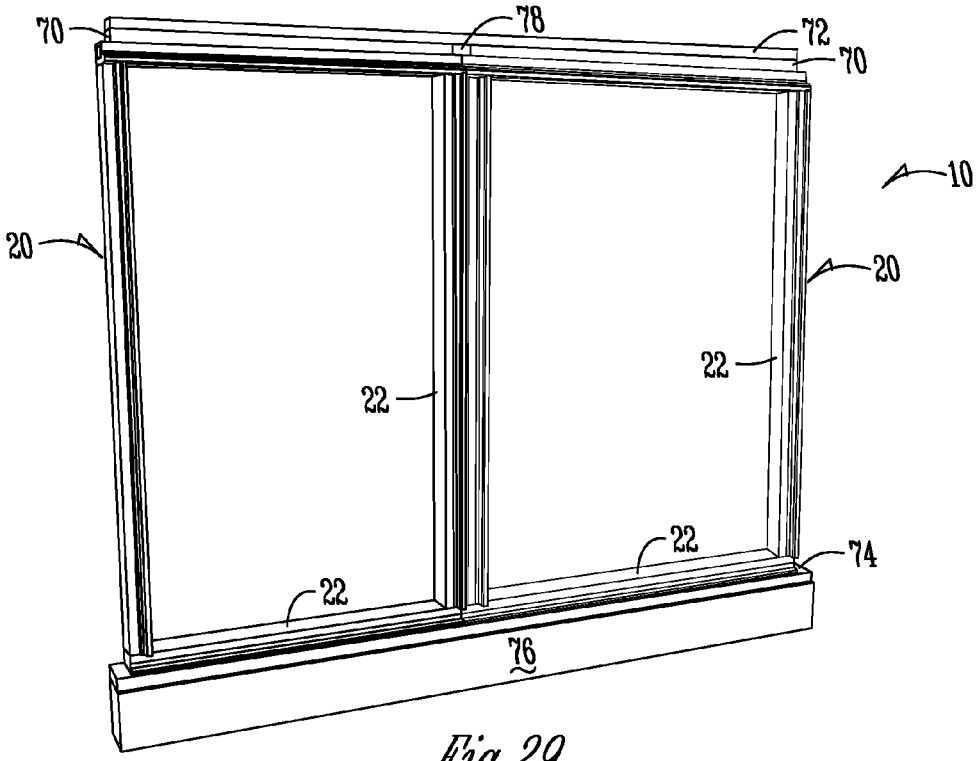

Once the structural frames 20 have been shipped to the construction site, frame members 22 may be attached to a bottom sill plate 74 secured to foundation 76 or the floor system constructed as shown in FIGS. 24-25. Each structural frame 20 may be joined to bottom sill plate 74 by anchoring the bottom horizontal frame member 22 to bottom sill plate 74 using anchoring means such as anchoring bolts or other means known in the art. Subsequent structural frames 20 may be attached to bottom sill plate 74 in this same manner as shown in FIG. 26 and further attached to an adjacent structural frame 20 using connector plate 66 illustrated in FIG. 27. Connector plate 66 may be attached to adjoining frame members 22 of structural frames 20 using attachment means known in the art, such as for example, screws, rivets, welds, anchors, bolts, and other attachment means. An insulation cap 78 may be inserted over top connector plate 66 to fill the void between wood nailers 70 and to provide a flush surface for attaching sill plate 72 to the top of wood nailers 70 to provide a continuous connection between frame members 22 and for integrating or incorporating wall panel 10 into other wall systems of a structure.

Figure 30:
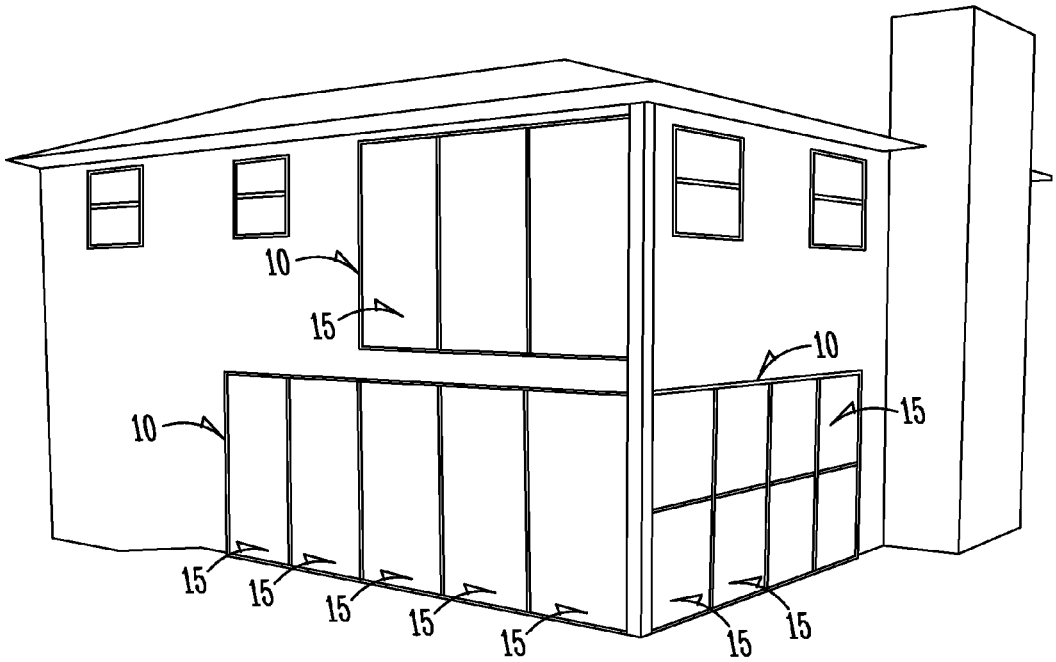
FIG. 30 shows a modern residential structure utilizing an embodiment adapted with a photovoltaic glazing according to an exemplary embodiment of the present invention.

FIG. 30 shows another alternative embodiment of the present invention. In FIG. 30, photovoltaic elements are introduced into glass panes 48 of glazing unit 46 so as to convert sunlight into electricity. Those skilled in the art can appreciate that photovoltaics could be applied to sheathing 30. Photovoltaic (PV) systems utilize thin layers of semi-conductive material, usually silicon, to convert light energy into electrical energy. The silicon sheets are usually encased in a glass or polymer panel, creating a PV "module" that can be mounted virtually anywhere there is sunlight. The electrical energy generated by the PV unit can be used directly, sold back to the power grid, or stored in batteries for later use.

There are a few different configurations of silicon in the PV elements available today, including monocrystalline, multicrystalline, thick film, and amorphous. Monocrystalline silicon is the most efficient (around 15%), but most expensive because it requires higher quality silicon and precise manufacturing. Amorphous silicon is the least efficient (around 6%), but can be created in very thin sheets that allow it to be installed nearly anywhere.

In the past, PV technology limited installation to large, stand-alone panels mounted on roof tops. However, with advances in PV efficiency and manufacturing processes, PV elements are now being directly incorporated into the building itself, hence the term "building-integrated photovoltaics (BIPV)." These new integrated products include PV roof tiles, installed much like normal roof shingles, and thin PV film that can be applied to a variety of surfaces, including glass, as illustrated in FIG. 30. These photovoltaic elements may be applied to the present invention in a variety of configurations conforming to an aesthetic pattern, such as a grid style photovoltaic coating or a series of panels incorporating thin film photovoltaic coatings. According to another embodiment, a residential construction could be configured with wall panel 10 of the present invention where the glass panes utilize a grid style photovoltaic coating on the lower half of the insulated glass units. This configuration restricts the sunlight passing through the wall, allowing for electricity production while still utilizing natural lighting for the interior of the structure. In another embodiment, a contemporary residential structure may be configured for utilizing the present invention with thin film photovoltaic glazing. The thin film coating allows a limited amount of sunlight to pass through the insulated glass unit, allowing for more privacy than the grid style coating. If increased insulation is desired, besides the option of more thermally efficient insulting glass units, translucent insulation material such as silica aerogel or other products can be placed in the air space between the sheathing 30 and glazing unit 46.

These figures are only presented as examples, and a variety of other arrangements may be incorporated into the present invention. The photovoltaic coating may be used to create semi-transparent, translucent, or opaque areas on the glass pane. Utilizing a variety of these coatings in combination with transparent uncoated glass, any aesthetic design can be accomplished.

Therefore apparatuses and methods for providing a structurally sound, energy savings wall for residential construction have been disclosed. The present invention contemplates numerous variations, options, and alternatives and is not to be limited to the specific embodiment described herein.

What is claimed is:

1. A residential structure, comprising:

a foundation having a foundation load weight and a floor load bearing surface;

a floor having a floor load weight and a panel load bearing surface, the floor connected to the floor load bearing surface of the foundation;

a roof having a roof load weight and a roof load bearing surface;

a load bearing panel having a panel load weight, the load bearing panel comprising a top surface and a bottom surface spaced apart by opposing side surfaces, the top surface and bottom surface both connected together by the opposing side surfaces;

the top surface of the load bearing panel connected to the roof load bearing surface;

the bottom surface of the load bearing panel connected to the panel load bearing surface of the floor;

the roof, the floor and the foundation connected together by the load bearing panel, wherein:

a. a top surface load of the load bearing panel comprises at least the roof load weight;

b. a bottom surface load of the load bearing panel comprises at least a summation of the roof load weight and the panel load weight;

the load bearing panel comprising:

a. a plurality of frame members comprising a top frame member, a bottom frame member and opposing side frame members, the top and bottom frame members connected together by the opposing side frame members;

b. a transparent sheathing layer bearing surface on the top frame member, the bottom frame member and the opposing side frame members;

c. a transparent sheathing layer having a top edge, a bottom edge and opposing side edges, the top edge, the bottom edge, and the opposing side edges spaced apart by parallel first and second opposing sides;

d. a panel bearing surface on the first side of the transparent sheathing layer, the panel bearing surface connected to the top frame member, the bottom frame member and the opposing side frame members of the load bearing panel;

e. a glazing frame bearing surface on the second side of the transparent sheathing layer;

f. a plurality of glazing frame members comprising a top glazing frame member, a bottom glazing frame member and opposing side glazing frame members, the top and bottom glazing frame members connected together by the opposing side glazing frame members, the top glazing frame member, the bottom glazing frame member and the opposing side glazing frame members connected to the glazing frame bearing surface; and g. a glazing unit connected to the plurality of glazing frame members.

2. The residential structure of claim 1 further comprises:

a second floor located in the residential structure at or above the load bearing panel, the second floor having a second floor load weight wherein:

a. the top surface load of the load bearing panel comprises at least a summation of the roof load weight the second floor load weight;

b. the bottom surface load of the load bearing panel comprises at least a summation of the roof load weight, the second floor load weight and the panel load weight.

3. The residential structure of claim 1 wherein at least one of the plurality of glazing frame members comprises a pressure plate to hold the glazing unit in place.

4. The residential structure of claim 1 wherein the glazing unit comprises:

a. an insulated glass unit;

b. a monolithic glass unit; or c. a laminated glass unit.

5. The residential structure of claim 1 wherein the transparent sheathing layer comprises:

a. a polycarbonate sheet; or b. an acrylic sheet.

6. The residential structure of claim 1 further comprising at least a first load bearing panel and a second load bearing panel, a side of the first load bearing panel having a connection to a side of the second load bearing panel, and wherein the first load bearing panel has a shear load and the second load bearing panel has the shear load carried by the connection.

7. A dwelling constructed of one or more transparent load bearing panels for bearing at least structural loads of the dwelling, the dwelling comprising:

a load bearing panel having a panel load weight, the load bearing panel comprising a top surface and a bottom surface spaced apart by opposing side surfaces, the top surface and bottom surface both connected together by the opposing side surfaces;

a foundation having a foundation load weight and a panel load bearing surface, the bottom surface of a load bearing panel connected to the panel load bearing surface of the foundation;

a roof having a roof load weight and a roof load bearing surface, the top surface of the load bearing panel connected to the roof load bearing surface;

the roof and the foundation connected together by the load bearing panel, wherein:

a. a top surface load on the load bearing panel comprises at least the roof load weight;

b, a side surface load on the load bearing panel comprises at least a summation of the roof load weight and a portion of the panel load weight;

c. a bottom surface load on the load bearing panel comprises at least a summation of the roof load weight and the panel load weight;

the load bearing panel comprising:

a. a plurality of frame members comprising a top frame member, a bottom frame member and opposing side frame members, the top and bottom frame members connected together by the opposing side frame members;

b. a transparent sheathing layer bearing surface on the top frame member, the bottom frame member and the opposing side frame members;

c. a transparent sheathing layer having a top edge, a bottom edge and opposing side edges, the top edge, the bottom edge, and the opposing side edges spaced apart by parallel first and second opposing sides;

d. a panel bearing surface on the first side of the transparent sheathing layer, the panel bearing surface connected to the top frame member, the bottom frame member and the opposing side frame members of the load bearing panel;

e. a glazing frame bearing surface on the second side of the transparent sheathing layer;

f. a plurality of glazing frame members comprising a top glazing frame member, a bottom glazing frame member and opposing side glazing frame members, the top and bottom glazing frame members connected together by the opposing side glazing frame members, the top glazing frame member, the bottom glazing frame member and the opposing side glazing frame members connected to the glazing frame bearing surface; and g. a glazing unit connected to the plurality of glazing frame members.

8. The dwelling of claim 7 wherein the glazing unit comprises a glass panel.

9. The dwelling of claim 7 wherein the transparent sheathing layer is a polycarbonate sheath or an acrylic sheath.

10. The dwelling of claim 7 wherein at least one of the plurality of glazing frame members comprises a mullion secured to a pressure plate for securing the glazing unit.

11. The dwelling of claim 7 further comprising:

a floor having a floor load weight and a panel load bearing surface, the floor connected to the panel load, bearing surface of the foundation.

12. The dwelling of claim 7 further comprising:

a plurality of the load bearing panels having a connection between opposing side edges, a shear load on at least one of the plurality of the load bearing panels and the shear load carried by the connection in the adjoining load bearing panels.

13. The dwelling of claim 7 wherein the glazing unit comprises:

a. an insulated glass unit;
b. a monolithic glass unit; or
c. a laminated glass unit.

14. A structure, comprising:

a load bearing panel having a panel load weight, the load bearing panel comprising a top surface and a bottom surface spaced apart by opposing side surfaces, the top surface and bottom surface both connected together by the opposing side surfaces;

a first structural load weight having a first load bearing surface, the first structural load weight located in the structure at or above the load bearing panel and the first load bearing surface connected to the top surface of the load bearing panel;

a top surface load on the load bearing panel comprises at least the first structural load weight;

a bottom surface load on the load bearing panel comprises at least a summation of the first structural load weight and the panel load weight;

the load bearing panel comprising:

a. a plurality of frame members comprising a top frame member, a bottom frame member and opposing side frame members, the top and bottom frame members connected together by the opposing side frame members;

b. a transparent sheathing layer bearing surface on the top frame member, the bottom frame member and the opposing side frame members;

c. a transparent sheathing layer having a top edge, a bottom edge and opposing side edges, the top edge, the bottom edge, and the opposing side edges spaced apart by parallel first and second opposing sides;

d. a panel bearing surface on the first side of the transparent sheathing layer, the panel bearing surface connected to the top frame member, the bottom frame member and the opposing side frame members of the load bearing panel;

e. a glazing frame bearing surface on the second side of the sheathing layer;

f. a plurality of glazing frame members comprising a top glazing frame member, a bottom glazing frame member and opposing side glazing frame members, the top and bottom glazing frame members connected together by the opposing side glazing frame members, the top glazing frame member, the bottom glazing frame member and the opposing site glazing frame members connected to the glazing frame bearing surface; and g. a glazing unit connected to the plurality of glazing frame members.

15. The structure of claim 14 further comprises:

a second structural load weight having a second load bearing surface, the second structural load weight located in the structure at or above the load bearing panel and the second load bearing surface connected to the top surface of the load bearing panel, wherein the top surface load on the load bearing panel comprises at least a summation of the first structural load weight and the second structural load weight.

16. The structure of claim 14 wherein the first and second structural load weight comprise at least one of:

a. a roof;
b. a floor;
c. a wall;
d. one or more load bearing panels.

17. The structure of claim 14 wherein at least one of the plurality of glazing frame members comprises a pressure plate to hold the glazing unit in place.

18. The structure of claim 14 wherein the glazing unit comprises:

a. an insulated glass unit;
b. a monolithic glass unit; or
c. a laminated glass unit.

19. The structure of claim 14 wherein the transparent sheathing layer comprises:

a. a polycarbonate sheet; or
b. an acrylic sheet.

20. The structure of claim 14 further comprising:

a plurality of the load bearing panels having a connection between opposing side edges, a shear load on at least one of the plurality of the load bearing panels and the shear load carried by the connection in the adjoining load bearing panels.

21. A structure, comprising:

a load bearing panel having a panel load weight, the load bearing panel comprising a top surface and a bottom surface spaced apart by opposing side surfaces, the top surface and bottom surface both connected together by the opposing side surfaces;

a first structural load weight having a first load bearing surface, the first structural load weight located in the structure at or above the load bearing panel and the first load bearing surface connected to the top surface of the load bearing panel;

a top surface load on the load bearing panel comprises at least the first structural load weight;

a bottom surface load on the load bearing panel comprises at least a summation of the first structural load weight and the panel load weight;

the load bearing panel comprising:

a. a plurality of frame members comprising a top frame member, a bottom frame member and opposing side frame members, the top and bottom frame members connected together by the opposing side frame members;

b. a transparent sheathing layer bearing surface on the top frame member, the bottom frame member and the opposing side frame members;

c. a transparent sheathing layer having a top edge, a bottom edge and opposing side edges, the top edge, the bottom edge, and the opposing side edges spaced apart by parallel first and second opposing sides;

d. a panel bearing surface on the first side of the transparent sheathing layer, the panel bearing surface connected to the top frame member, the bottom frame member and the opposing side frame members of the load bearing panel;

e. a glazing frame bearing surface on the second side of the sheathing layer;

f. a plurality of glazing frame members comprising a top glazing frame member, a bottom glazing frame member and opposing side glazing frame members, the top and bottom glazing frame members connected together by the opposing side glazing frame members, the top glazing frame member, the bottom glazing frame member and the opposing side glazing frame members connected to the glazing frame bearing surface;

g. a glazing unit connected to the plurality of glazing frame members; and h. a component for converting solar energy to electricity.

22. The structure of claim 21 wherein the component comprises a photovoltaic coating on the glazing unit.

23. The structure of claim 21 wherein the component comprises a thin film or crystalline cells.

24. The structure of claim 21 further comprising:

insulation between the transparent sheathing layer and the glazing unit.

25. The structure of claim 21 further comprising:

aerogel between the transparent sheathing layer and the glazing unit.

26. A structure, comprising:

a load bearing panel having a panel load weight, the load bearing panel comprising a top surface and a bottom surface spaced apart by opposing side surfaces, the top surface and bottom surface both connected together by the opposing side surfaces;

a first structural load weight having a first load bearing surface, the first structural load weight located in the structure at or above the load bearing panel and the first load bearing surface connected to the top surface of the load bearing panel;

a top surface load on the load bearing panel comprises at least the first structural load weight;

a bottom surface load on the load bearing panel comprises at least a summation of the first structural load weight and the panel load weight;

the load bearing panel comprising:

a. a plurality of frame members comprising a top frame member, a bottom frame member and opposing side frame members, the top and bottom frame members connected together by the opposing side frame members;

b. a transparent sheathing layer bearing surface on the top frame member, the bottom frame member and the opposing side frame members;

c. a transparent sheathing layer having a top edge, a bottom edge and opposing side edges, the top edge, the bottom edge, and the opposing side edges spaced apart by parallel first and second opposing sides;

d. a panel bearing surface on the first side of the transparent sheathing layer, the panel bearing surface connected to the top frame member, the bottom frame member and the opposing side frame members of the load bearing panel;

e. a glazing frame bearing surface on the second side of the sheathing layer;

f. a plurality of glazing frame members comprising a top glazing frame member, a bottom glazing frame member and opposing side glazing frame members, the top and bottom glazing frame members connected together by the opposing side glazing frame members, the top glazing frame member, the bottom glazing frame member and the opposing side glazing frame members connected to the glazing frame bearing surface;

g. a glazing unit connected to the plurality of glazing frame members; and h. insulation between the transparent sheathing layer and the glazing unit.

27. The structure of claim 26 further comprising:

a solar energy capturing component.

28. The structure of claim 26 further comprising on the glazing unit at least one of:

a. a photovoltaic coating;

b. a thin film;

c. crystalline cells.

29. The structure of claim 26 wherein the insulation is transparent or translucent.

* * * * *